US011533970B1

(12) United States Patent
Tseng

(10) Patent No.: US 11,533,970 B1
(45) Date of Patent: Dec. 27, 2022

(54) MAGNETIC BUCKLE

(71) Applicant: Duraflex Hong Kong Limited, Hong Kong (CN)

(72) Inventor: Ming Yen Tseng, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/536,287

(22) Filed: Nov. 29, 2021

(51) Int. Cl.
*A44B 11/25* (2006.01)

(52) U.S. Cl.
CPC ..... *A44B 11/2592* (2013.01)

(58) Field of Classification Search
CPC ..... A44B 11/2592; A44B 11/258; A44B 11/2584; A44B 11/2588; Y10T 24/32; A44D 2203/00
See application file for complete search history.

(56) References Cited

U.S. PATENT DOCUMENTS

| | | | | |
|---|---|---|---|---|
| 5,572,887 | A | 11/1996 | Geswelli | |
| 6,292,985 | B1 | 9/2001 | Grunberger | |
| 6,857,169 | B2 * | 2/2005 | Chung | A44B 11/258 24/303 |
| 9,101,185 | B1 | 8/2015 | Greenberg | |
| 9,907,367 | B2 * | 3/2018 | Paik | A41F 1/002 |
| 9,936,772 | B2 * | 4/2018 | Paik | A44B 11/2588 |
| 10,085,521 | B2 | 10/2018 | Chen et al. | |
| 10,143,270 | B2 | 12/2018 | Fiedler et al. | |
| 10,376,022 | B2 | 8/2019 | Duncan et al. | |
| 10,874,178 | B2 * | 12/2020 | Cheng | A44B 11/2511 |
| D917,333 | S | 4/2021 | Duncan et al. | |
| 11,083,251 | B2 | 8/2021 | Fiedler | |
| 11,412,820 | B2 * | 8/2022 | Prasitkittanai | A44C 5/20 |
| 2004/0107547 | A1 | 6/2004 | Chung | |

(Continued)

FOREIGN PATENT DOCUMENTS

| | | | |
|---|---|---|---|
| CN | 1555234 | A | 12/2004 |
| CN | 205214395 | U | 5/2016 |

(Continued)

OTHER PUBLICATIONS

International Search Report and Written Opinion of the International Searching Authority in PCT/CN2021/116962, dated Dec. 7, 2021.

(Continued)

*Primary Examiner* — Robert Sandy
(74) *Attorney, Agent, or Firm* — Collard & Roe, P.C.

(57) ABSTRACT

A buckle assembly has a first buckle portion, a second buckle portion and a locking lid. The first and second buckle portions have magnets that attract each other. The locking lid is connected to the first buckle portion and has a sliding element, a spring connected to the siding element, a pivot axle for connecting the locking lid to the first buckle portion, and front and rear attachment elements. The second buckle portion has engagement flanges for engaging the front and rear attachment elements. The first and second buckle portions are connected together by placing the first and second buckle portions together so that the magnets attract each other, sliding the sliding element against a force of the spring until the attachment elements engage the engagement flanges, and then releasing the sliding element to return the spring to a resting position.

14 Claims, 12 Drawing Sheets

(56) References Cited

U.S. PATENT DOCUMENTS

| | | | | |
|---|---|---|---|---|
| 2012/0044031 | A1 | 2/2012 | Ninomiya | |
| 2014/0277103 | A1 | 9/2014 | Esposito | |
| 2015/0074954 | A1 | 3/2015 | Pruitt et al. | |
| 2018/0132570 | A1 | 5/2018 | Chen et al. | |
| 2019/0357641 | A1 | 11/2019 | Duncan et al. | |
| 2020/0229547 | A1 | 7/2020 | Lemarbe et al. | |
| 2020/0367611 | A1* | 11/2020 | Cheng | B62B 9/24 |

FOREIGN PATENT DOCUMENTS

| | | | |
|---|---|---|---|
| CN | 205306147 | U | 6/2016 |
| CN | 206612290 | U | 11/2017 |
| CN | 206852181 | U | 1/2018 |
| CN | 108495569 | A | 9/2018 |
| CN | 208176194 | U | 12/2018 |
| CN | 111264979 | A | 6/2020 |
| DE | 10 2018 121 771 | A1 | 3/2020 |
| FR | 2861553 | A1 | 5/2005 |
| WO | 03/005847 | A1 | 1/2003 |

OTHER PUBLICATIONS

International Search Report and Written Opinion of the International Searching Authority in PCT/CN2021/113530, dated Nov. 24, 2021.

* cited by examiner

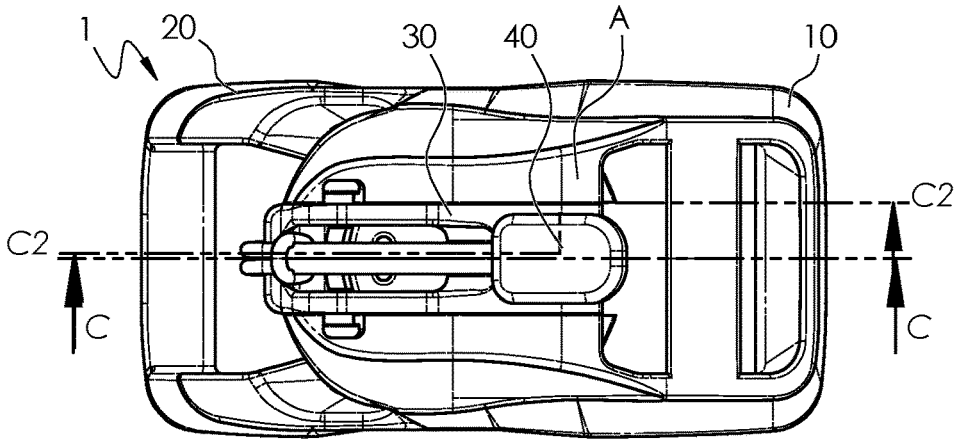
Fig. 13
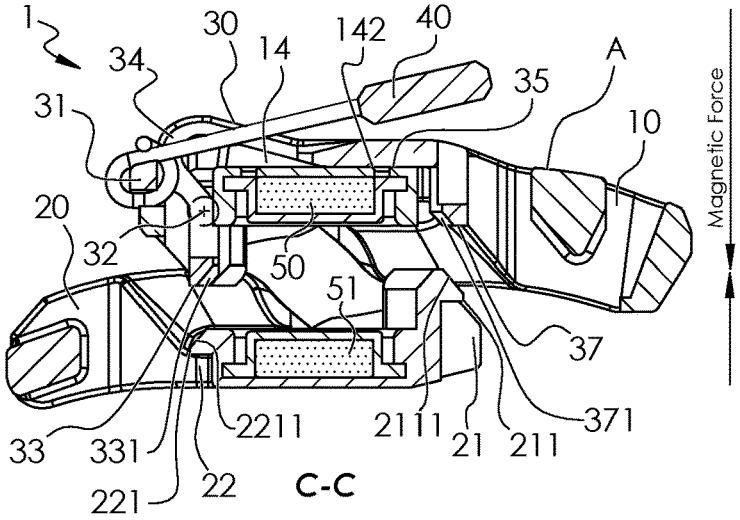
Fig. 13C
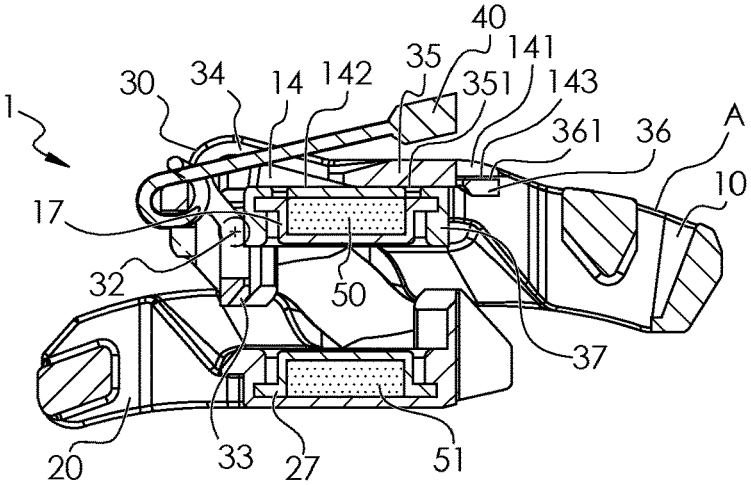
C2-C2
Fig. 13C2

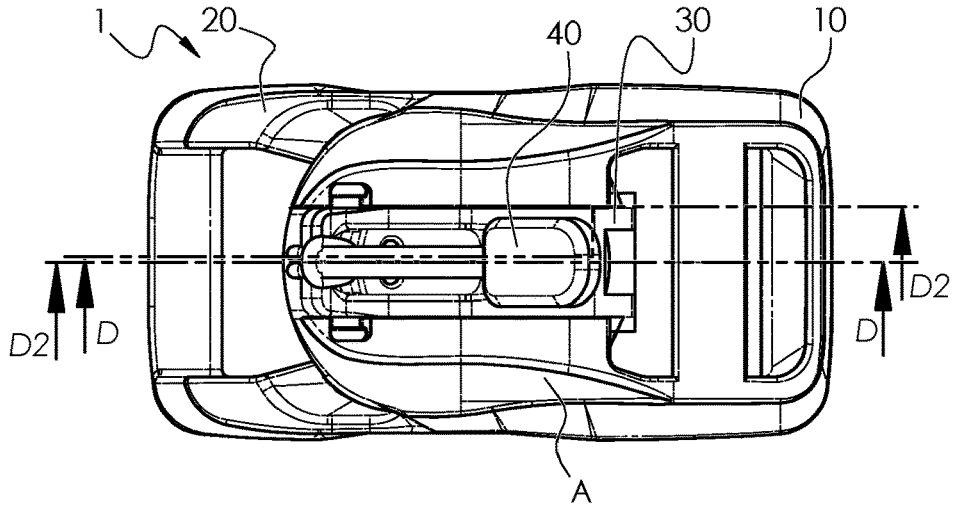
Fig. 14
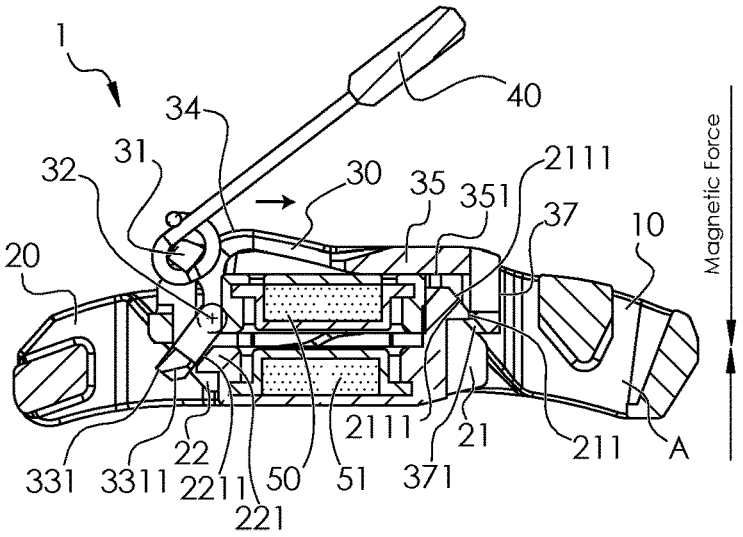
D-D
Fig. 14D
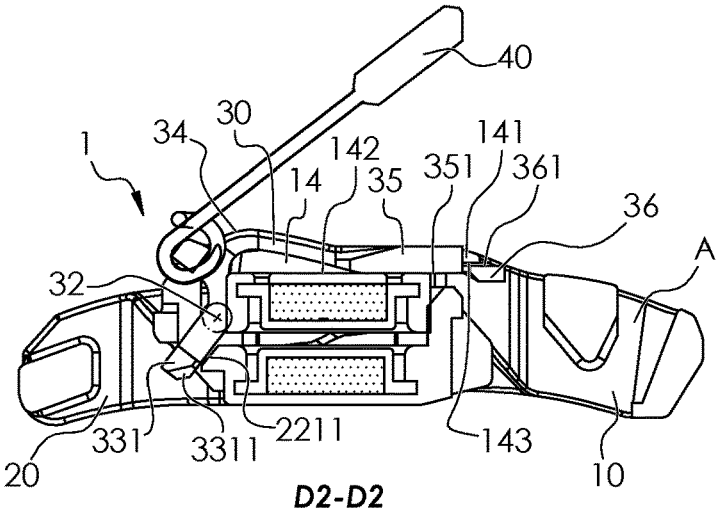
D2-D2
Fig. 14D2

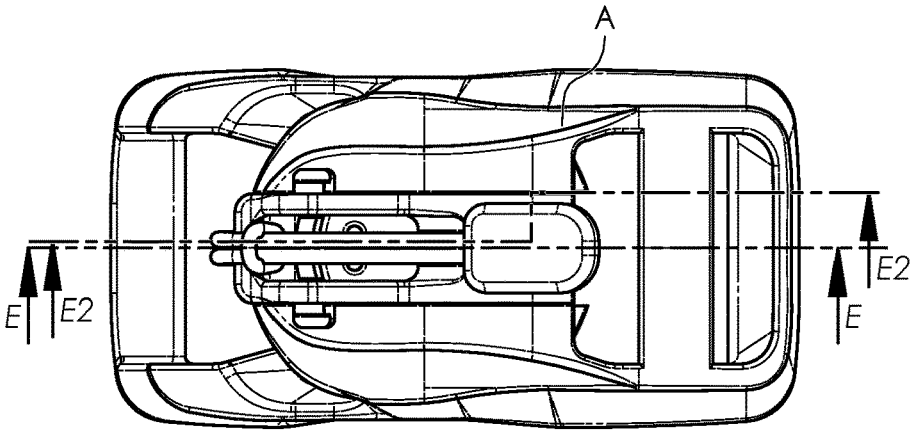
Fig. 15
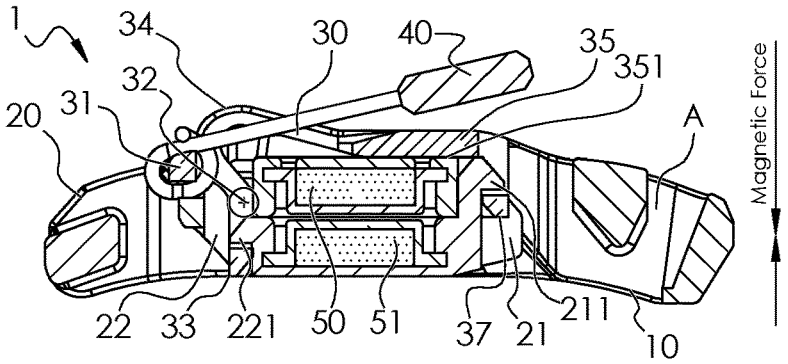
E-E
Fig. 15E
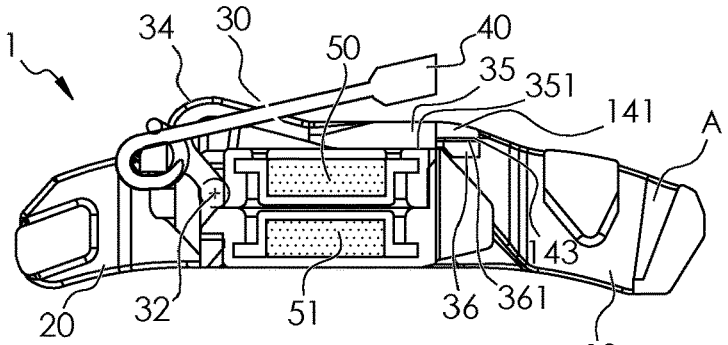
E2-E2
Fig. 15E2

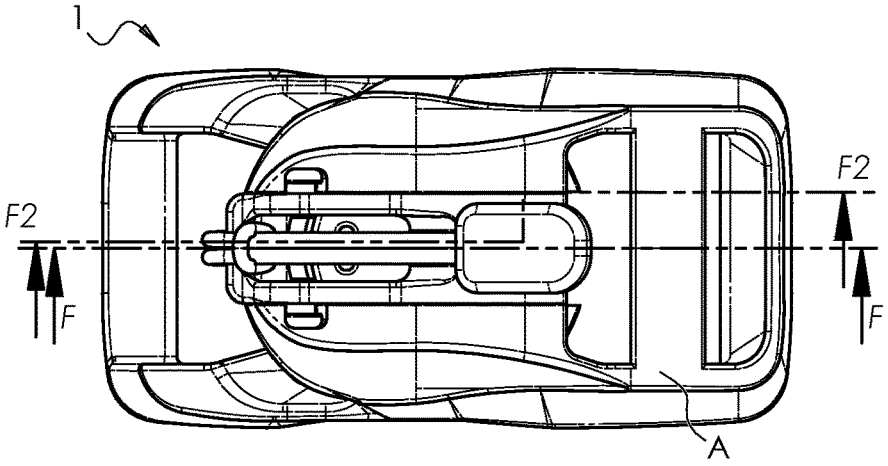
Fig. 16
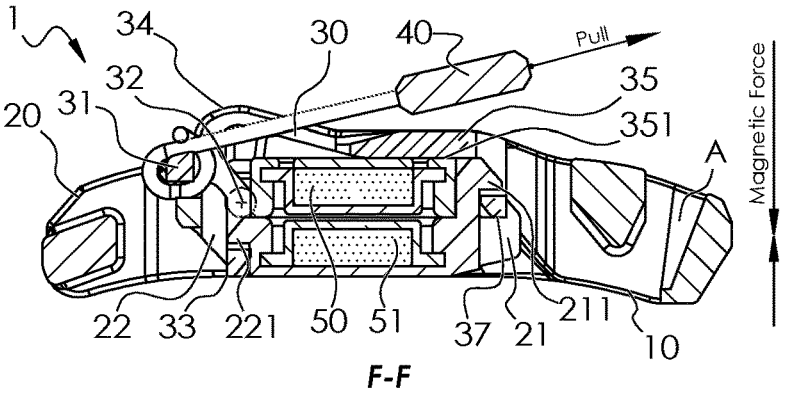
Fig. 16F
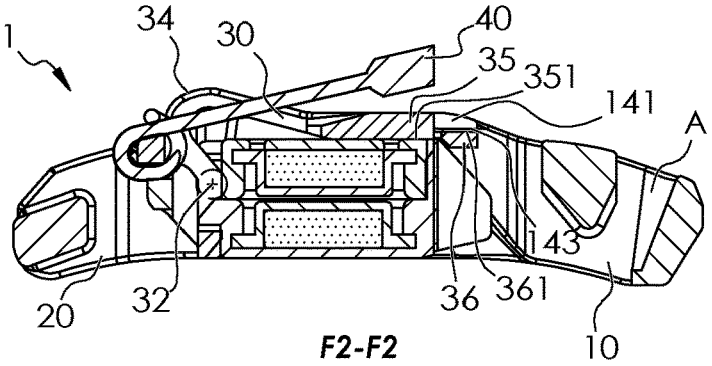
Fig. 16F2

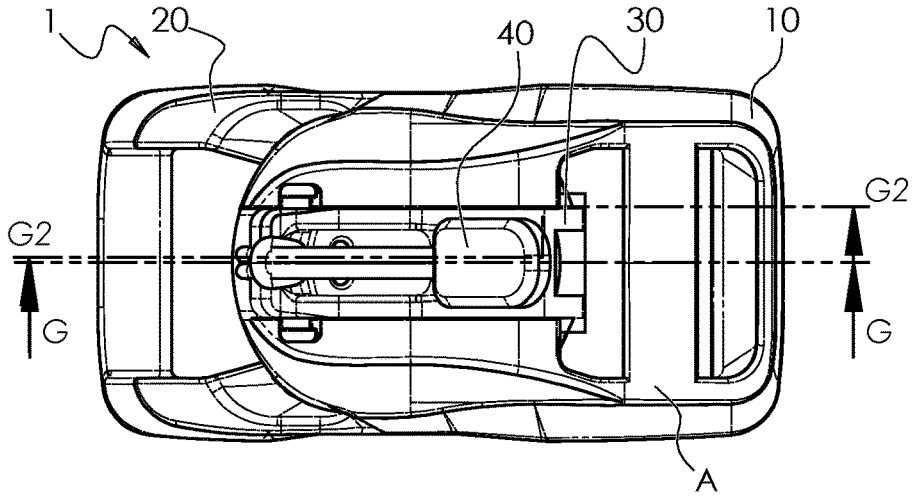
Fig. 17
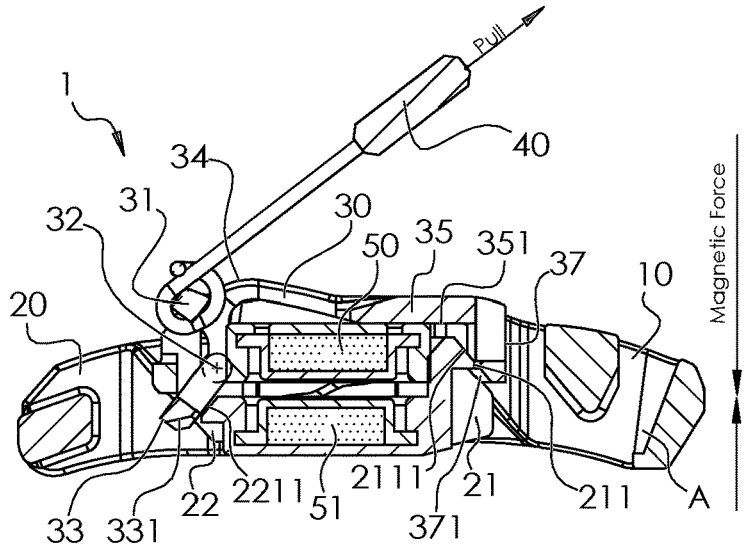
G-G
Fig. 17G
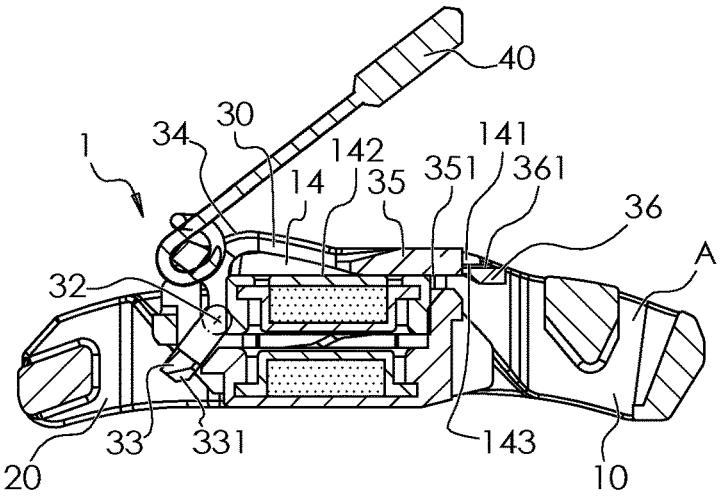
G2-G2
Fig. 17G2

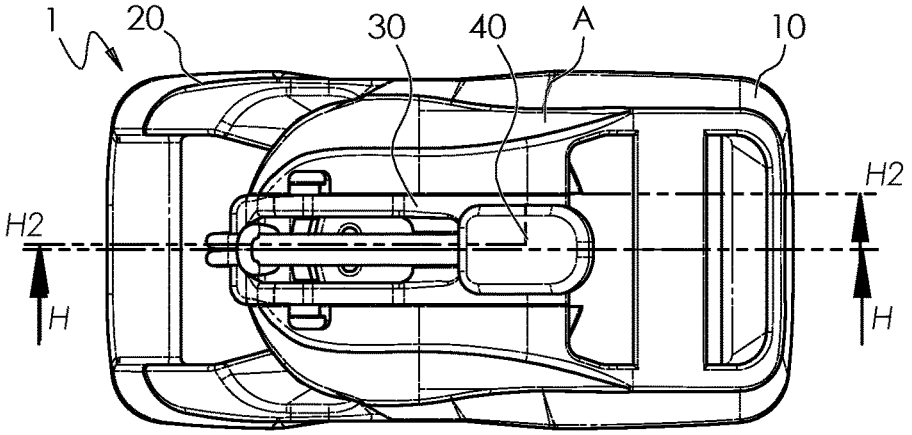
Fig. 18
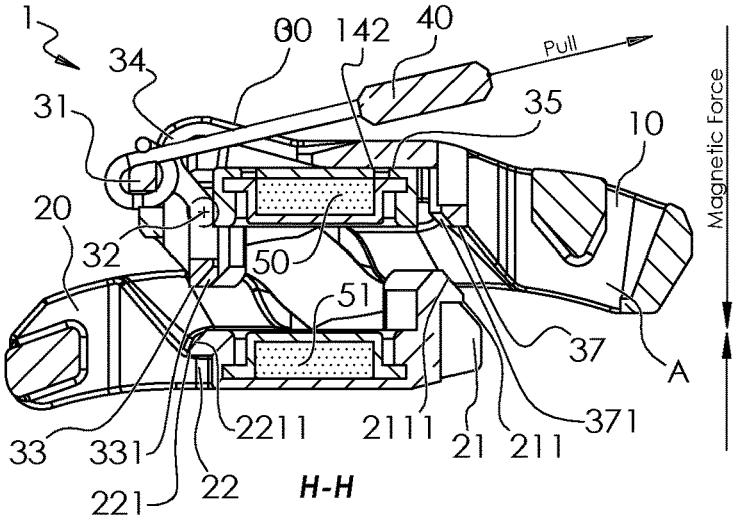
Fig. 18H
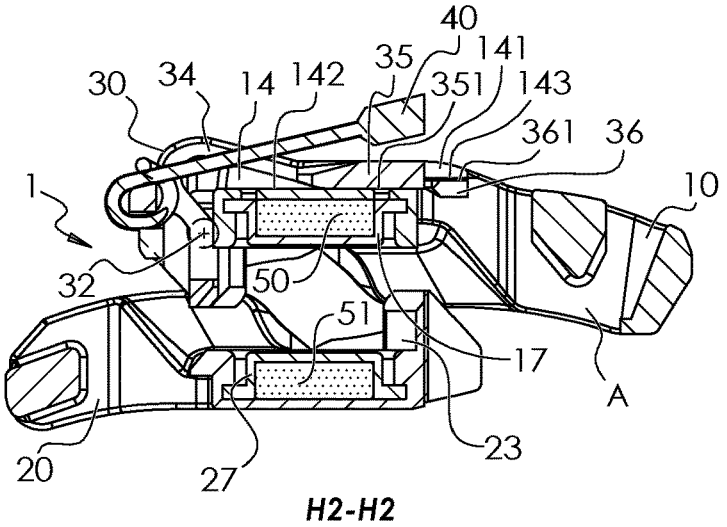
Fig. 18H2

MAGNETIC BUCKLE

BACKGROUND OF THE INVENTION

1. Field of the Invention

This invention relates to a magnetic buckle. In particular, the invention relates to a two-piece sliding buckle that is held in place by cooperating magnets on each of the pieces.

2. The Prior Art

Two-piece buckles are often used to connect two straps together, such as in a seat belt. Often, the buckles are locked together via a spring-loaded latching mechanism, which can be released by raising or lowering a latch, or by pressing a button.

SUMMARY OF THE INVENTION

It is an object of the invention to provide a two-piece buckle assembly that is simple to engage and disengage, and is secure in locking.

This and other objects are accomplished by a buckle assembly having a first buckle portion that cooperates with a second buckle portion, as well as a locking lid that is connected to the first buckle portion and assists in locking and unlocking the two buckle portions to and from each other. Each of the buckle portions can have at least one strap retaining bar so that the buckle portions can be used to connect two straps or articles together. Preferably, at least one of the buckle portions has two strap retaining bars so that a strap can be adjustably connected thereto. The strap retaining bars of the first buckle portion are located at an opposite end of the strap retaining bars of the second buckle portion when the two buckle portions are locked together.

Each of the buckle portions has a base body with a plurality of exterior surfaces, and a plurality of interior surfaces. The first buckle portion has a first base body with a first front recess on one longitudinal end of the first base body, a first rear recess on an opposite longitudinal end of the first base body, and a magnet enclosed in the first base body between the first front recess and the first rear recess. The second buckle portion has a second base body with a second front recess on one longitudinal end of the second base body and a second rear recess on an opposite longitudinal end of the second base body, a magnet enclosed in the second base body, a front engagement flange disposed between the second front recess and the magnet, a rear engagement flange disposed between the second rear recess and the magnet.

The locking lid is connected to the first buckle portion and is formed by a sliding element, a spring connected to the sliding element, a pivot axle arranged adjacent the spring, a front attachment element arranged adjacent the pivot axle, and a rear attachment element connected to an end of the sliding element opposite the pivot axle. The front attachment element extends through the first front recess of the first buckle portion, the rear attachment element extends through the first rear recess of the first buckle portion and the pivot axle is rotatably held in the first buckle portion to connect the locking lid to the first buckle portion.

The first and second buckle portions can be connected together by placing the interior surfaces of the first buckle portion against the interior surfaces of the second buckle portion, which causes the magnets to attract each other, and then sliding the sliding element of the locking lid toward the first rear recess against a force of the spring until the front attachment element of the locking lid engages the front engagement flange of the second buckle portion and the rear attachment element of the locking lid engages the rear engagement flange of the second buckle portion. The sliding element is then released to return the spring to a resting position with the engagement flanges holding the front and rear attachment elements in a locked position.

In one embodiment, there is a pull lever connected to the spring, opposite the pivot axle. The first buckle portion can be disengaged from the second buckle portion when the buckle portions are in the locked position by pulling on the pull lever in a direction away from the second buckle portion, against a force of the spring, until the front attachment element pivots around the pivot axle to release the front attachment element from the first engagement flange, and sliding the sliding element toward the first rear recess until the rear attachment element disengages from the rear engagement flange. A pull head on a pull strap can be connected to the pull lever to assist in moving the lever against the force of the spring.

The pivot axle is connected to the first buckle portion by inserting it into a pivot recess in the first buckle portion. The pivot recess contains opposing pivot slots that receive the pivot axle so that is held in the slots but can rotate with pressure from the pull lever.

To further secure the two buckle portions together and prevent disengagement under stress in the horizontal direction, the first and second buckle portions can each comprise at least one tooth that engages the magnet housing of the opposing buckle portion when the buckle portions are in the locked position. The teeth prevent the buckle portions from moving past each other under tension from straps connected to the respective buckle portions.

The magnets can be circular magnets that are encased in cylindrical housings in the first and second buckle portions. The teeth can be configured so as to directly abut the circular housings. Preferably, there are at least two teeth on each of the buckle portions, which abut the cylindrical housing on a same side of the housing, and opposite the location of the teeth from the opposing buckle portion.

In a preferred embodiment, the front attachment element and the rear attachment element of the locking lid are each configured as loops, with two vertical support posts and a horizontal bar between the vertical support posts. The engagement flanges of the second buckle portion are inserted into each of the loops on top of the horizontal bars to lock the two buckle portions together.

To assist in locking and unlocking, the horizontal bars have a guide slope that allows the bars to slide along the engagement flanges of the second buckle portion during locking and unlocking. Alternate structures to the loops, such as a wall with a horizontal groove or opening, could also be envisioned.

In one embodiment, the locking lid is disposed in a guide track on the first buckle portion. The guide track has a floor, side walls and an overhanging lip. The locking lid has securing flanges on a rear end of the locking lid, which abut an underside of the overhanging lip to retain the locking lid on the first buckle portion in a slidable but not a pivotable manner.

Preferably, the spring is a flat deformation spring that bends under compressive force from the pull lever or from a finger, and expands back to a resting position when released. The deformation of the spring causes the locking lid to slide along the guide track on the first buckle portion during locking and unlocking of the buckle portions from each other. The spring is preferably integrally molded in one piece with the sliding element and the pivot axle.

To further assist in aligning the buckle portions with each other, the first buckle portion has a pair of sloped interior sliding surfaces, and the second buckle portion has a pair of correspondingly sloped interior sliding surfaces, on each side of the respective base bodies. The sliding surfaces of the first buckle portion slide along and mate with the sliding surfaces of the second buckle portion during locking of the first buckle portion to the second buckle portion.

The buckle assembly of the present invention provides a secure locking arrangement, enhanced by magnets, that can be easily locked and unlocked by movement of the locking lid. The structure of the first and second buckle portions as well as the attractive force of the magnets ensure that the buckle portions are accurately aligned when brought together, which allows the engagement flanges to easily secure the attachment elements to securely lock the buckle portions together.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 13 is a top view of the buckle assembly in an unassembled state;

FIG. 13C is a cross-sectional view along lines C-C of FIG. 13;

FIG. 13C2 is a cross-sectional view along lines C2-C2 of FIG. 13;

FIG. 14 is a top view of the buckle assembly during locking of the two parts together;

FIG. 14D is a cross-sectional view along lines D-D of FIG. 14;

FIG. 14D2 is a cross-sectional view along lines D2-D2 of FIG. 14;

FIG. 15 is a top view of the buckle assembly in a fully locked position;

FIG. 15E is a cross-sectional view along lines E-E of FIG. 15;

FIG. 15E2 is a cross-sectional view along lines E2-E2 of FIG. 15;

FIG. 16 is a top view of the buckle assembly at the beginning of an unlocking operation;

FIG. 16F is a cross-sectional view along lines F-F of FIG. 16;

FIG. 16F2 is a cross-sectional view along lines F2-F2 of FIG. 16;

FIG. 17 is a top view of the buckle assembly as the buckle portions are being unlocked;

FIG. 17G is a cross-sectional view along lines G-G of FIG. 17;

FIG. 17G2 is a cross-sectional view along lines G2-G2 of FIG. 17;

FIG. 18 is a top view of the buckle assembly after separation of the two buckle portions;

FIG. 18H is a cross-sectional view along lines H-H of FIG. 18; and

FIG. 18H2 is a cross-sectional view along lines H2-H2 of FIG. 18.

DETAILED DESCRIPTION OF THE EMBODIMENTS

Figure 1:
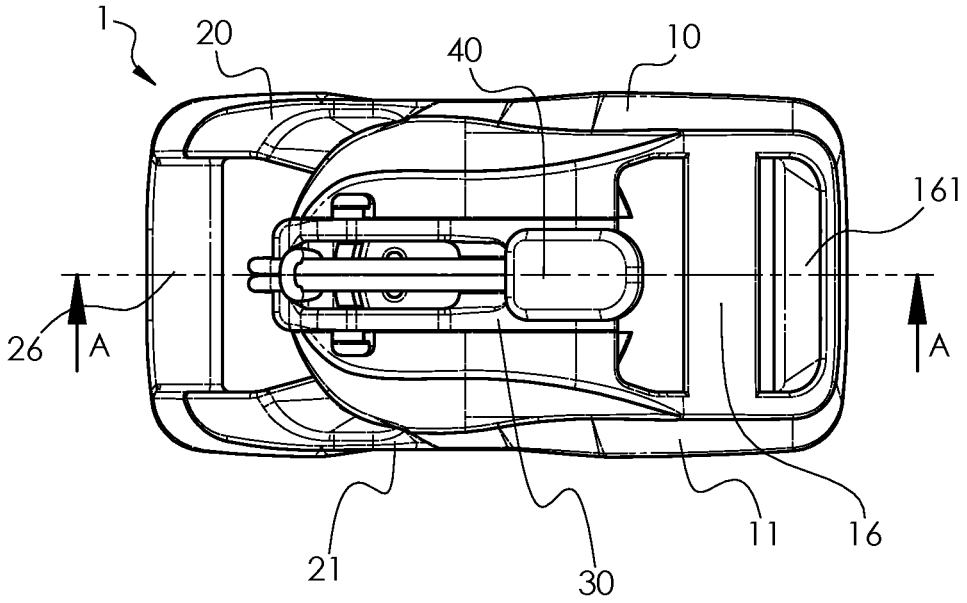
FIG. 1 is a top view of the buckle assembly according to the invention.

FIGS. 1-3A show buckle assembly 1 in a fully assembled position. Buckle assembly 1 consists of a first buckle portion 10, a second buckle portion 20, and a locking lid 30 connected to a pull head 40. Embedded in housing 17 of first buckle portion 10 is a first magnet 50, and embedded in housing 27 of second buckle portion 20 is a second magnet 51. Magnets 50 and 51 attract each other when the buckle portions 10, 20 are brought near each other, to assist in aligning the buckle portions for locking. First buckle portion 10 has strap retaining bars 16, 161 to allow for adjustable attachment of a strap. Second buckle portion 20 has a single strap retaining bar 26 for attachment of another strap in a non-adjustable manner. Other strap retaining arrangements could also be used, such as adjustable strap retaining bars on both buckle portions.

First buckle portion 10 will now be described in detail with reference to FIGS. 4-8. First buckle portion 10 has a main body with a front recess 11 and a rear recess 12, both of which extend entirely through first buckle portion 10. Two teeth 13 extend downward from the bottom surface of first buckle portion 10. Each tooth 13 has a rearwardly sloping guiding surface 131 at its free end. A guide track 14 is disposed along the top surface of first buckle portion 10. Guide track 14 has a track floor 142, side walls 141 and an overhanging lip 143 on each side, extending from side walls 141. The underside of first buckle portion 10 has an interior surface 15, which accommodates housing 17 of magnet 50.

Figure 9:
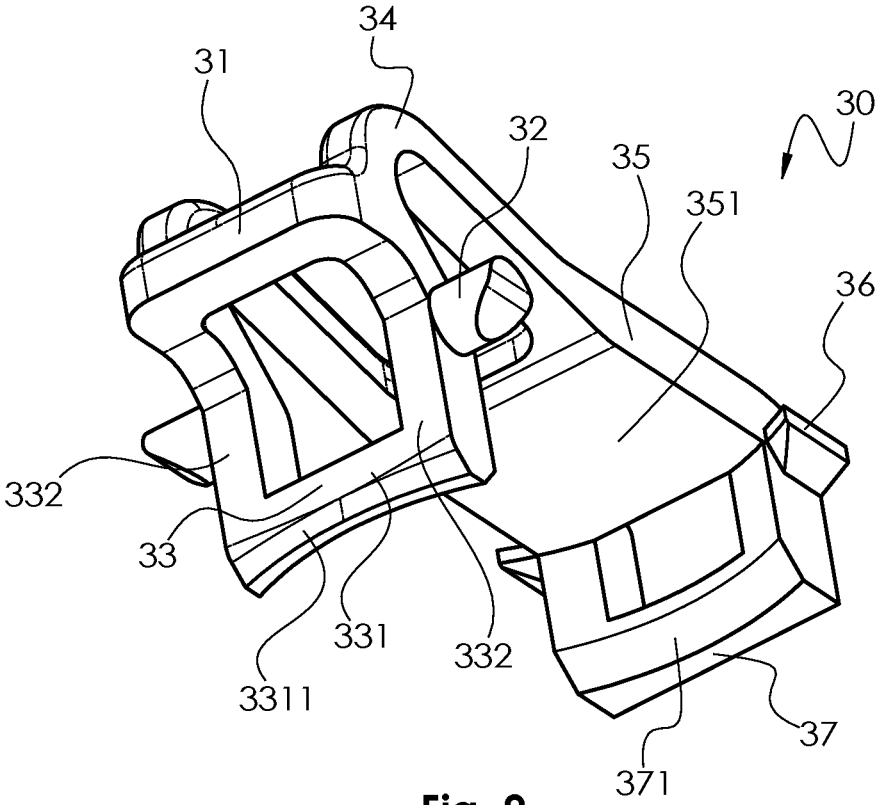
FIG. 9 is a bottom perspective view of the locking lid
Figure 10:
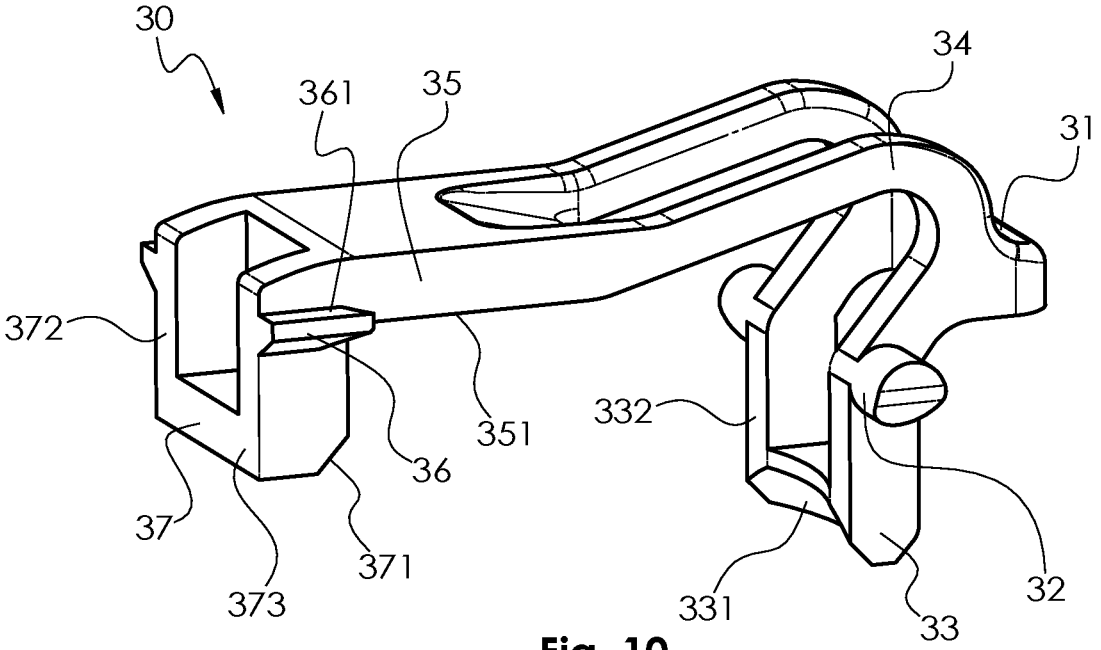
FIG. 10 is a side perspective view of the locking lid.

Locking lid 30, shown in FIGS. 4-6 and 9-10, is formed of a slider section 35 connected to a spring in the form of a deformation section 34. On the opposite side of deformation section 34 is a pull lever 31 connected to pivot axles 32. Below pivot axles 32 is an attachment element in the form of a front loop 33, having two side bars 332 connected to a horizontal bar 331, having a sloped guiding section 3311 (FIG. 9). At the opposite end of locking lid 30 is a rear attachment element in the form of a rear loop 37, which is formed of two side bars 372 connected to a horizontal bar 373, which has a guide slope 371 on its interior face (FIG.

10). Adjacent rear loop 37 are slide securing flanges 36, which extend outward and each have a top face 361.

Figure 6:
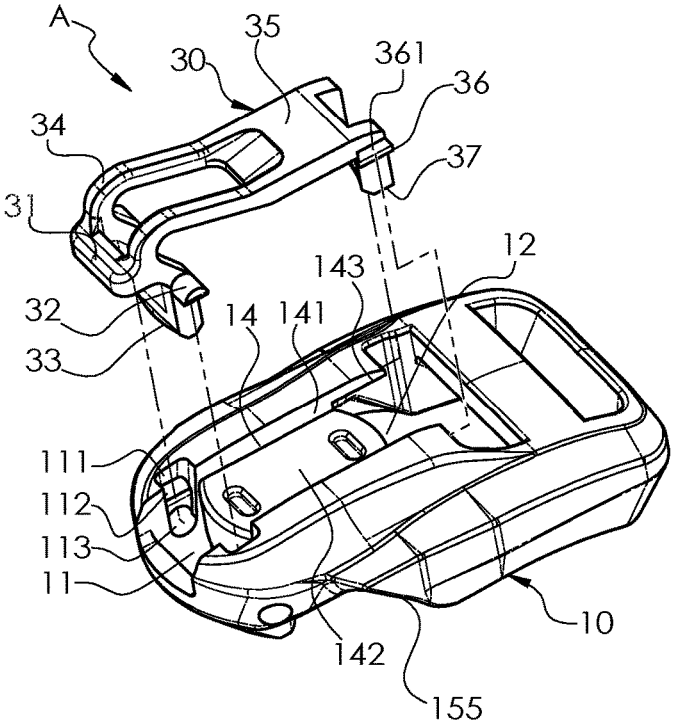
FIG. 6 is an exploded perspective view of the first buckle portion and locking lid.
Figure 7:
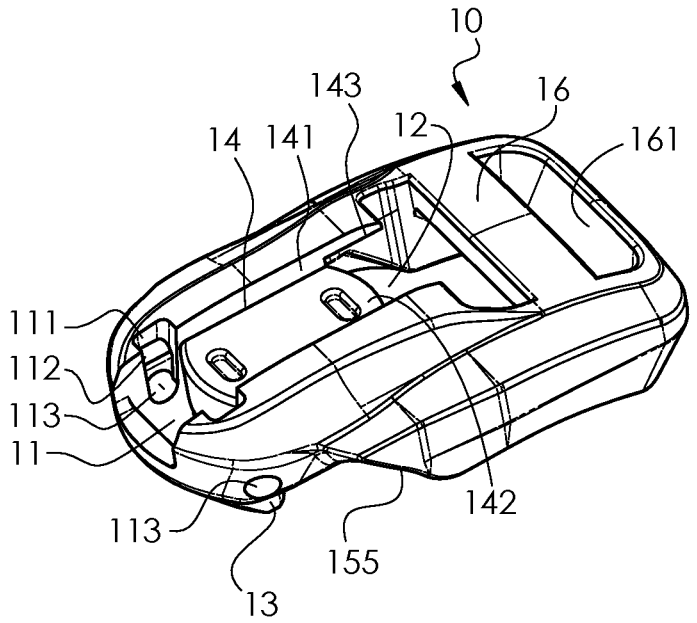
FIG. 7 is a top perspective view of the first buckle portion without the locking lid.
Figure 8:
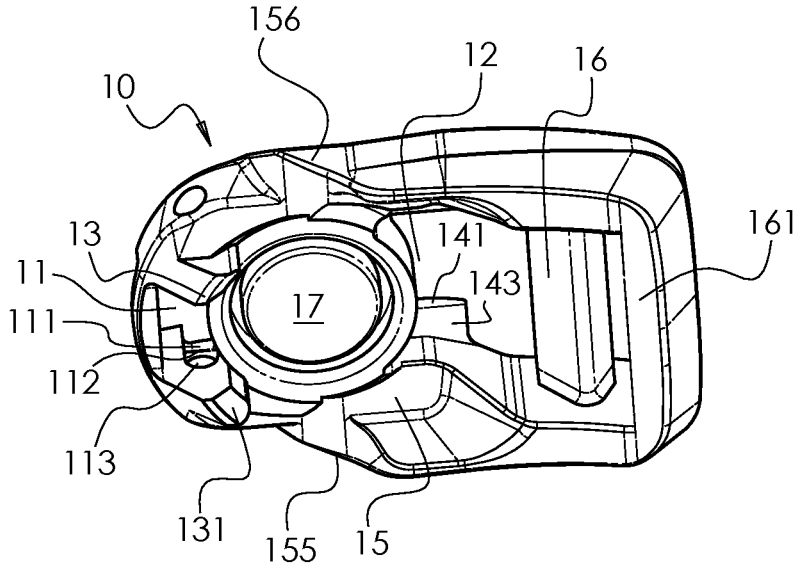
FIG. 8 is a bottom perspective view of the first buckle portion.

Locking lid 30 is connected to first buckle portion 10 to form an upper buckle assembly A by inserting front loop 33 into front recess 11 and inserting rear loop 37 into rear recess 12, as shown in FIG. 6. Then, pivot axles 32 are inserted into pivot slots 113 in pivot recess 111 on first buckle portion 10. A guide slope 112 in recess 111 is provided for assisting the sliding of pivot axles 32 into slots 113, where the pivot axles can rotate but not be inadvertently removed. The opposite end of locking lid 30 is secured to first buckle portion 10 by sliding securing flanges 36 under overhanging lips 143 of first buckle portion 10 so that upper surface 361 of securing flanges abut overhanging lips 143 and cannot be raised upward. At this point, locking lid 30 is secured to first buckle portion 10 in a manner such that locking lid 30 can move only in a siding direction toward and away from strap retaining bar 161. The sliding motion can be obtained by forcing deformation section 34 to bend under pressure, so that the sliding section can move along track 14 but not be removed from first buckle portion 10.

Figure 11:
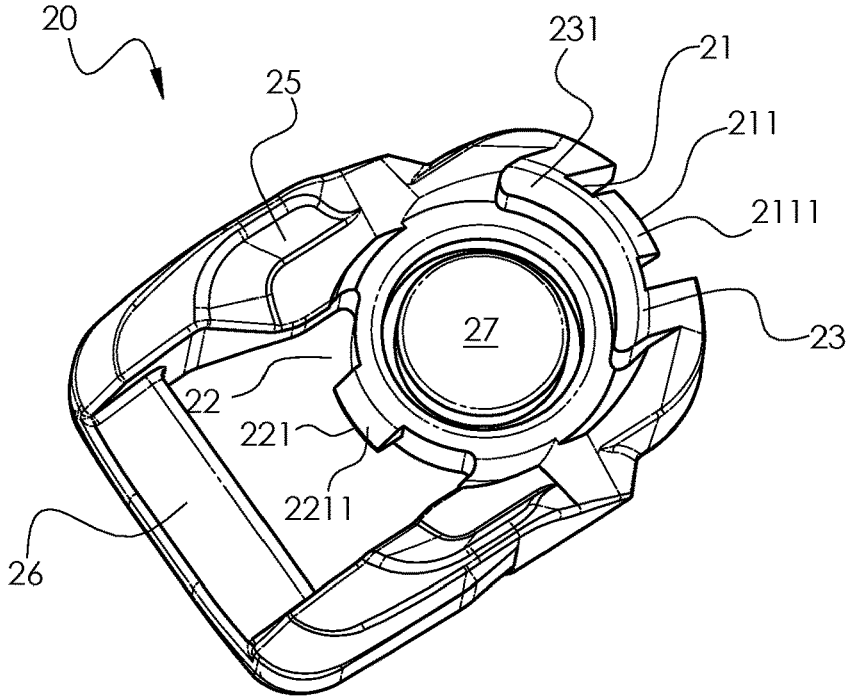
FIG. 11 is a top perspective view of the second buckle portion.
Figure 12:
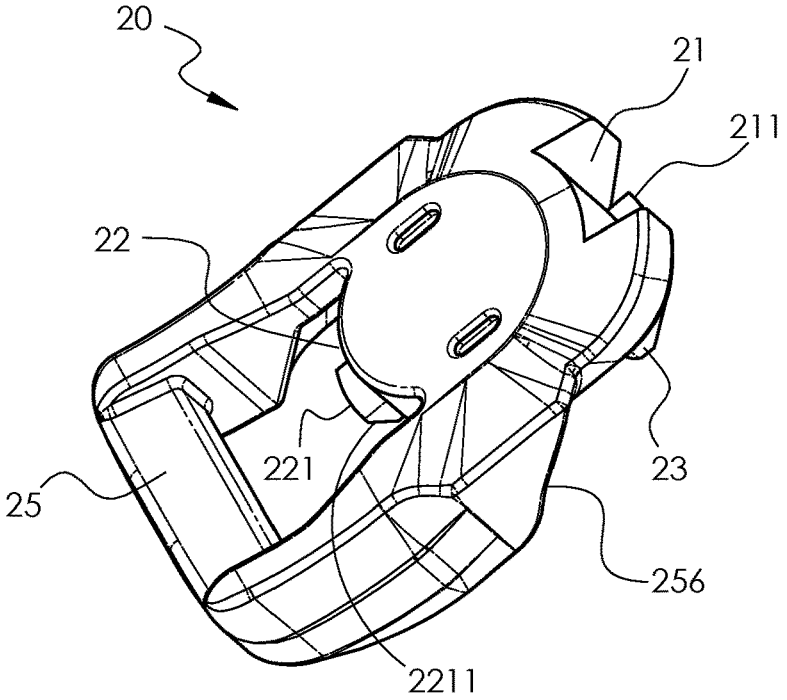
FIG. 12 is a bottom perspective view of the second buckle portion.

Second buckle portion 20 is shown in FIGS. 11 and 12. Second buckle portion 20 has a front recess 22 and a rear recess 21. A tooth 23 extends upward from rear buckle portion 20 adjacent rear recess 21, and has a guide slope 231. Housing 27 encases magnet 51 in between the two recesses 22, 21. Adjacent rear recess 21 is a rear engagement flange 211, which has a guide slope 2111, and adjacent front recess 22 is a front engagement flange 221, which has a guide slope 2211.

Figure 2:
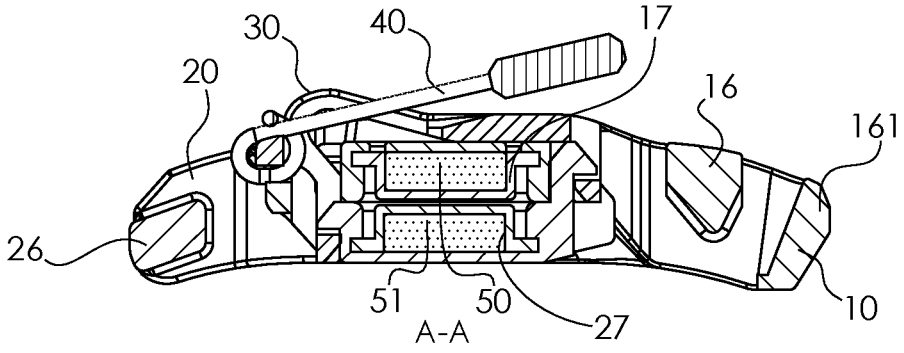
FIG. 2 is a cross-sectional view along lines A-A of FIG. 1.
Figure 3:
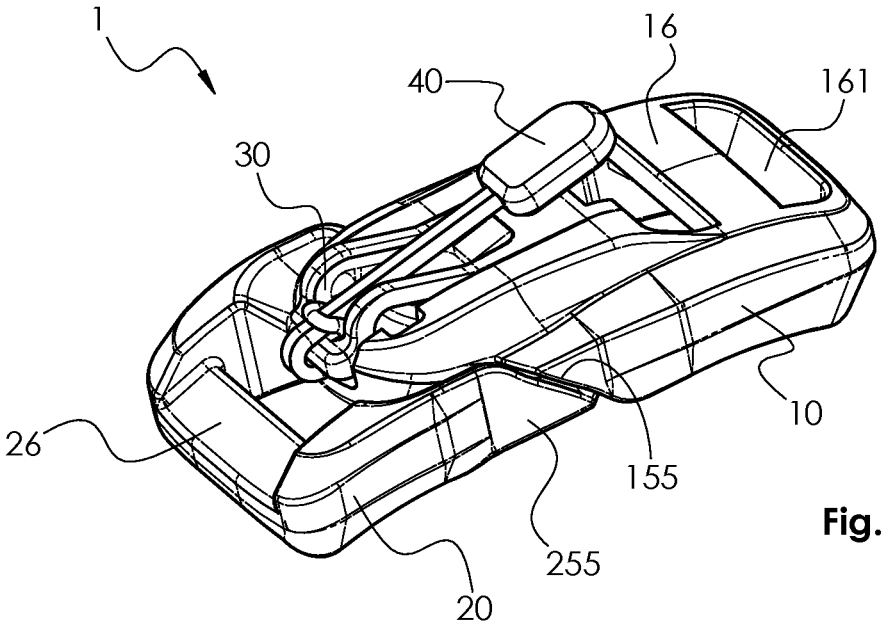
FIG. 3 is a top perspective view of the buckle assembly according to the invention.
Figure 3A:
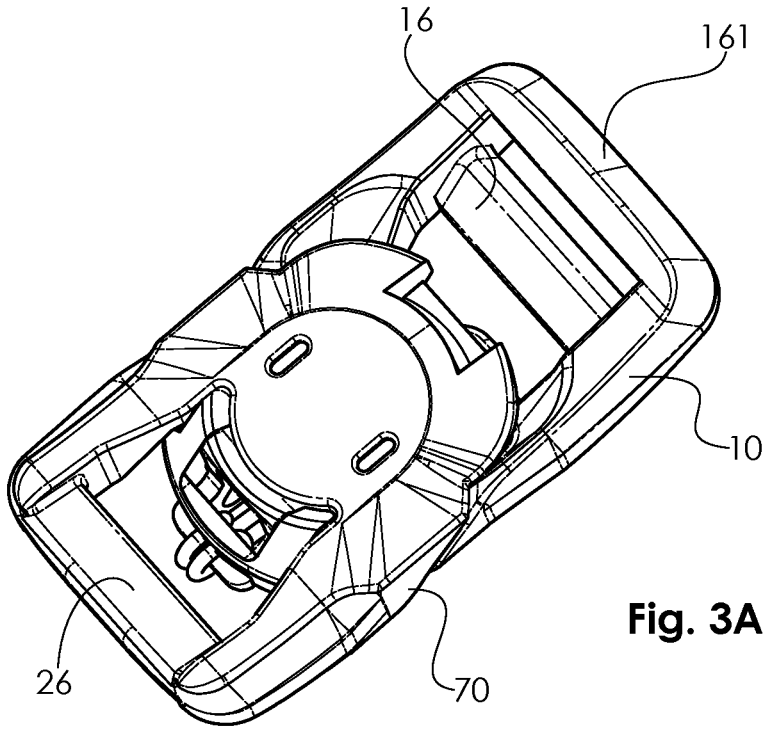
FIG. 3A is a bottom perspective view of the buckle assembly according to the invention.
Figure 4:
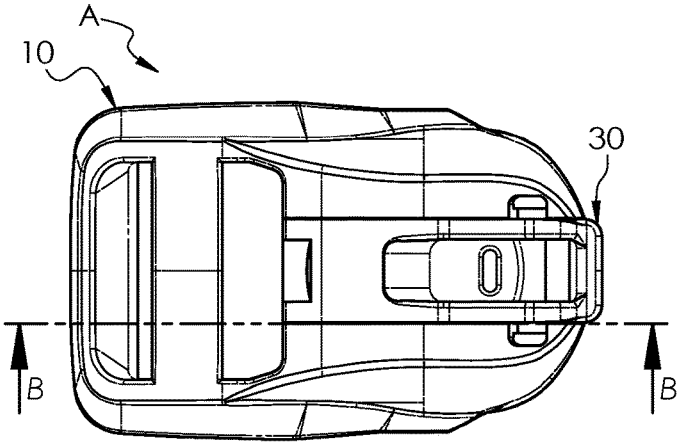
FIG. 4 is a top view of the first buckle portion with locking lid.
Figure 5:
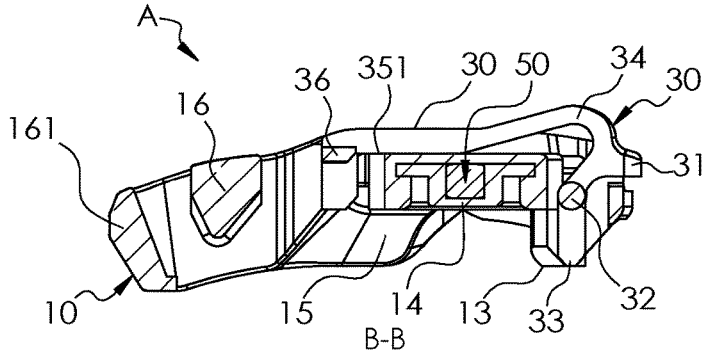
FIG. 5 is a cross-sectional view along lines B-B of FIG. 4.

The connection of upper buckle assembly A formed by first buckle portion 10 and locking lid 30, to second buckle portion 20 is shown in FIGS. 13-15C2. As shown in FIGS. 13, 13C and 13C2, the buckle portions 10 and 20 are brought close to each other, so that magnets 50 and 51 attract each other and align the two parts together. Sloped sliding surfaces 155, 156 of first buckle portion 10 slide along sloped sliding surfaces 255, 256 of second buckle portion 20 to assist in this alignment (as shown in FIGS. 3-8). At this stage, front loop 33 is directed to front recess 22 of second buckle portion 20, and rear loop 37 is directed toward rear recess 21 of second buckle portion 20.

As shown in FIGS. 14, 14D and 14D2, once the buckle portions 10, 20 are brought together, rear engagement flange 211 abuts the lower surface 351 of slider section 35. Meanwhile, front loop 33 abuts front engagement flange 221, causing deformation section 34 to flex as pivot axles 32 rotate in pivot slots 113. Rear loop 37 also abuts rear engagement flange 211. Further pressure to bring the two buckle portions together forces deformation section 34 to bend, and causes horizontal bar 331 of front loop 33 to slide with its guide slope 3311 along the guide slope 2211 of front engagement flange 221, and at the same time causes horizontal bar 371 to slide along the guide slope 2111 of rear engagement flange 211 as slider section 35 moves horizontally toward the rear of buckle assembly 1. Pressure on the buckle portions is maintained until horizontal bar 331 clears front engagement flange 221, and horizontal bar 371 clears rear engagement flange 211, causing the engagement flanges 221, 211 to snap over and secure the front and rear loops 33,37 to second buckle portion 20, as shown in FIGS. 15, 15E and 15E2. Once this occurs, slider section 35 moves back to its original location and deformation section 34 is restored to a resting position, with buckle portions 10, 20 held securely together. At this point as well, teeth 13 of first buckle portion 10 rest against housing 27 of second buckle portion 20, and tooth 23 of second buckle portion 20 rests against housing 17 of first buckle portion 10 to prevent the buckle portions from becoming disengaged under horizontal forces caused by straps attached to strap retaining bars 16, 161, and 26.

The disengagement of first and second buckle portions 10 and 20 is shown in FIGS. 16-18H2. The user begins the disengagement process by pulling on pull head 40 as shown in FIG. 16F, which causes pull lever 31 to rotate axles 32 inside pivot slots 113 and cause deformation section 34 to deform as shown in FIGS. 16, 16F and 16F2. At the same time, this rotating movement causes horizontal bar 331 of front loop 33 to slide out of engagement with front engagement flange 221 as shown in FIG. 17G. In addition, the force of deformation spring 34 causes sliding section 35 to slide rearward and move horizontal bar 371 of rear loop 37 out of engagement with rear engagement flange 211, as shown in FIGS. 17G and 17G2. At this point, the two buckle portions 10, 20 can be separated by breaking the magnetic force between magnets 50, 51, i.e., by continued pulling on pull head 40 until the magnetic attraction is broken and the two buckle parts 10, 20 are separated, as shown in FIGS. 18, 18H and 18H2.

Accordingly, while only a few embodiments of the present invention have been shown and described, it is obvious that many changes and modifications may be made thereunto without departing from the spirit and scope of the invention.

What is claimed is:

1. A buckle assembly comprising:

a first buckle portion comprising a first base body, a first front recess on one longitudinal end of the first base body, a first rear recess on an opposite longitudinal end of the base body, and a magnet attached to the first base body between the first front recess and the first rear recess, a second buckle portion comprising a second base body, a second front recess on one longitudinal end of the second base body, a second rear recess on an opposite longitudinal end of the second base body, a magnet attached to the second base body, a front engagement flange disposed between the second front recess and the magnet, and a rear engagement flange disposed between the second rear recess and the magnet, and a locking lid connected to the first buckle portion, the locking lid comprising a sliding element, a spring connected to the siding element, a pivot axle arranged adjacent the spring, a front attachment element arranged adjacent the pivot axle, and a rear attachment element connected to an end of the sliding element opposite the pivot axle, wherein the front attachment element extends through the first front recess of the first buckle portion, the rear attachment element extends through the first rear recess of the first buckle portion and the pivot axle is rotatably held in the first buckle portion to connect the locking lid to the first buckle portion, wherein the first and second buckle portions are configured such that placing the first buckle portion against the second buckle portion causes the magnets to attract each other, and the first and second buckle portions are configured to be locked together by sliding the sliding element toward the first rear recess against a force of the spring until the front attachment element engages the front engagement flange and the rear attachment element engages the rear engagement flange, and then releasing the sliding element to return the spring to a resting position with the engagement flanges holding the front and rear attachment elements in a locked position.

2. The buckle assembly according to claim 1, further comprising a pull lever connected to the spring, wherein the first buckle portion is configured to be disengaged from the second buckle portion when the buckle portions are in the locked position by pulling on the pull lever in a direction away from the second buckle portion, against a force of the spring, until the front attachment element pivots around the pivot axle to release the front attachment element from the first engagement flange, and sliding the sliding element toward the first rear recess until the rear attachment element disengages from the rear engagement flange.

3. The buckle assembly according to claim 2, further comprising a pull head connected to the pull lever.

4. The buckle assembly according to claim 1, further comprising at least one strap retaining bar connected to at least one of the first or second buckle portions.

5. The buckle assembly according to claim 1, wherein the first buckle portion contains a pivot recess with opposing pivot slots that receive the pivot axle.

6. The buckle assembly according to claim 1, wherein the first buckle portion further comprises at least one tooth that engages the second buckle portion when the buckle portions are in the locked position.

7. The buckle assembly according to claim 1, wherein the second buckle portion further comprises at least one tooth that engages the first buckle portion when the buckle portions are in the locked position.

8. The buckle assembly according to claim 1, wherein the front attachment element and the rear attachment element are each configured as a loop with two vertical support posts and a horizontal bar between the two vertical support posts.

9. The buckle assembly according to claim 8, wherein the horizontal bars have a guide slope that allows the horizontal bars to slide along the engagement flanges of the second buckle portion during locking and unlocking.

10. The buckle assembly according to claim 1, wherein the locking lid is disposed in a guide track on the first buckle portion, the guide track having a floor, side walls and an overhanging lip, and further comprising securing flanges on a rear end of the locking lid, the securing flanges abutting an underside of the overhanging lip to retain the locking lid on the first buckle portion.

11. The buckle assembly according to claim 1, wherein the spring is a flat spring.

12. The buckle assembly according to claim 11, wherein the spring is integrally molded in one piece with the sliding element.

13. The buckle assembly according to claim 1, wherein the first buckle portion has a pair of sloped interior sliding surfaces, and the second buckle portion has a pair of correspondingly sloped interior sliding surfaces, and wherein the sliding surfaces of the first buckle portion slide along and mate with the sliding surfaces of the second buckle portion during locking of the first buckle portion to the second buckle portion.

14. The buckle assembly according to claim 1, wherein the magnets are circular and are encased in cylindrical housings in the first and second buckle portions.

* * * * *